US005335734A

United States Patent [19]

Scott et al.

[11] Patent Number: 5,335,734

[45] Date of Patent: Aug. 9, 1994

[54] RECIPROCATING ADDITIVE MIXING PUMP APPARATUS AND METHOD

[75] Inventors: Blayney J. Scott, Victoria; Barry G. Gilbert, Sidney; George R. Gowan, Burnstown, all of Canada

[73] Assignee: Scott Plastics Ltd., Vitoria, Canada

[21] Appl. No.: 55,878

[22] Filed: May 4, 1993

[51] Int. Cl.[5] ..... A62C 15/00; A62C 31/12

[52] U.S. Cl. ..... 169/15; 169/33; 417/76; 417/234; 417/503

[58] Field of Search ..... 417/76, 87, 234, 503; 222/482, 631, 190; 169/14, 15, 33

[56] References Cited

U.S. PATENT DOCUMENTS

| | | | |
|---|---|---|---|
| 615,213 | 11/1898 | Deming | 417/503 X |
| 664,237 | 12/1900 | Deming | 417/503 X |
| 862,867 | 8/1907 | Eggleston | 417/472 |
| 2,513,417 | 2/1946 | Lindsay | 261/116 |
| 3,234,962 | 2/1966 | Williamson | 137/565 |
| 3,701,482 | 10/1972 | Sachnik | 169/15 X |
| 4,147,478 | 4/1979 | Vork | 417/503 X |
| 4,645,009 | 2/1987 | Hawelka et al. | 169/15 |
| 4,688,643 | 8/1987 | Carter et al. | 169/33 |
| 4,805,700 | 2/1985 | Hoover | 169/14 X |
| 4,993,495 | 2/1991 | Burchert | 169/14 |
| 5,082,633 | 1/1992 | Stuper | 422/133 |
| 5,137,094 | 8/1992 | Broussard | 169/15 |

FOREIGN PATENT DOCUMENTS 1266073 2/1990 Canada .

OTHER PUBLICATIONS

Maverick Foam Vest System Brochure (See above U.S. Patent 5,137,094). Date of publication unknown.

*Primary Examiner*—Richard E. Gluck

*Attorney, Agent, or Firm*—Bull, Housser & Tupper

[57] ABSTRACT

A pump apparatus dispenses a liquid and additive mixture and has a pump cylinder with intake and discharge ports with associated valves. An additive supply communicates with the pump cylinder to supply additive with liquid drawn into the pump during an intake stroke prior to a discharge stroke during which a mixture of additive and liquid is discharged from the pump. The additive is mixed in the liquid prior to passing into the intake port and is metered to attain the desired concentration. An aerating nozzle receives mixture discharged from the discharge port to produce foam for various applications, such as fire fighting. The aerating nozzle has a restrictor orifice located adjacent and upstream from air entainment opening in the nozzle. The restrictor orifice can be a simple non-tapered cylindrical passage, but for improved foam generation, the orifice can be a diverging passage with a step between inlet and outlet portions of the passage.

24 Claims, 4 Drawing Sheets

RECIPROCATING ADDITIVE MIXING PUMP APPARATUS AND METHOD

BACKGROUND OF THE INVENTION

The invention relates to a reciprocating pump for mixing an additive with a liquid supply prior to discharging under pressure, particularly for mixing a fire fighting foam concentrate in water for use as a portable firefighting foam pump.

Portable reciprocating pumps for discharging liquids are old, and have many uses, e.g. for drawing liquid from a source and discharging the liquid often as a fine spray for controlled applications, e.g. as a herbicide spray. Another use relates to portable firefighting pumps, and a pump of this general type is shown in U.S. Pat. No. 4,688,643, issued to Fireflex Manufacturing Ltd., in which one of the co-inventors therein is also a co-inventor of the present invention. The pump in the patent is particularly for use in fighting small brush fires, and for this purpose a portable water or liquid supply is carried in a water container as a backpack on an operator's back. A flexible hose extends from the backpack to an intake of the pump, thus permitting the operator to discharge water in scattered pockets of brush fires while being some distance from a water supply.

While water is effective in many instances for suppressing brush fires and other Class A fires, it is well-known that the fire suppression effectiveness and versatility of water is improved considerably if a small amount of firefighting foam concentrate is mixed in the water, prior to discharge through an aeration nozzle or foam generating nozzle. Firefighting foam of this type can be used on Class B fires, namely fires from flammable liquids, such as gasoline fires, as well as on the more common Class A fires. Conventional firefighting foam apparatus requires a pressurized water source, such as a fire hydrant or a fire truck with a pump, and a relatively complex metering, mixing and foam generating apparatus which does not lend itself easily to widespread small brush fire applications which can be scattered over a wide and rugged terrain. Consequently, firefighting foam use has been limited to specialized fires requiring the foam, and due to the cost and complexity of prior art firefighting foam apparatus, in the past it has not been possible to take advantage of using foam in a low cost manner to fight Class A fires or small brush fires.

In addition, for marine applications, a specially formulated firefighting foam concentrate is used to generate foam from sea water as well as fresh water to permit extinguishing fires on marine vessels, in which many fires are commonly associated with flammable liquids such as engine fuel. While large marine vessels can be equipped with complicated and costly foam firefighting equipment, such investment is usually not justified for smaller recreational vessels. Consequently, for extinguishing Class B fires on recreational vessels, it is usual to use portable pressurized dry powder or foam extinguisher canisters which have relatively small capacity and, because of the limited space on a small vessel, can only be carried in relatively small quantities. Consequently, if a flammable liquid or Class B fire on a recreational vessel is not quickly extinguished while it is small, it can rapidly grow until it is too large to be tackled with the relatively small foam canisters, and it is not uncommon for marine vessels to be lost in this manner.

To the inventor's knowledge, there are no portable pumps which can be operated manually to generate firefighting foam from a small supply of firefighting foam concentrate which is mixed with an essentially unlimited supply of fresh water or sea water for fighting both Class A fires, e.g. brush or household fires, Class B fires e.g. flammable liquids, and also when on a marine vessel.

SUMMARY OF THE INVENTION

The invention reduces the difficulties and disadvantages of the prior art by providing a portable, manually operated light-weight, low cost pump which is provided with a relatively small supply of firefighting foam concentrate which can be added in an accurate concentration to an essentially unlimited supply of fresh water or sea water for generating firefighting foam, or foam for many other applications. The pumping apparatus can be used to draw water from a supply below the operator, e.g. water beneath a marine vessel, or water adjacent a lake shore, which can then be mixed with foam concentrate and applied to a marine fire or other application. These are appropriate applications where a body of water is conveniently located close to the fire. However, for use in areas remote from a convenient water supply, e.g. for extinguishing scattered brush fires, a supply of water can be provided in a backpack to be worn by the operator, which can provide a limited but portable supply of water for the apparatus.

While the apparatus has particular application for generating firefighting foam from a supply of water and foam concentrate, the apparatus could be used in many other applications in which an additive, e.g. a concentrate in liquid form, is added to another liquid in an accurately controlled amount for specific applications, e.g. generating a diluted or mixed chemical spray from a liquid and liquid chemical concentrates.

A reciprocating pump apparatus according to the invention is for dispensing a liquid and additive mixture, and the apparatus comprises a hollow pump body, a piston and associated piston rod and an additive supply. The hollow pump body provides a pump cylinder having a longitudinal pump axis. The pump cylinder communicates with an intake port having an intake valve, and a discharge port having a discharge valve, the intake port being communicable with a liquid supply. The piston and associated piston rod are reciprocable axially within the cylinder to execute intake and discharge strokes. The intake valve opens during an intake stroke to admit liquid while the discharge valve is closed, and the discharge valve opens during a discharge stroke while the intake valve is closed. The additive supply communicates with the pump cylinder to supply additive during an intake stroke so that the additive is admitted into the pump cylinder prior to a discharge stroke. The apparatus further comprises a mixing means for mixing the additive with the liquid, the mixing means admitting the additive into the liquid prior to passing into the intake port. The apparatus further comprises a metering means for metering a first volume of additive with a second volume of liquid to attain a desired concentration in the mixture, the metering means being provided between the additive supply and the mixing means.

A method of operating a reciprocating pump for dispensing a liquid and additive mixture comprises the steps of:

drawing liquid into a pump cylinder while executing an intake stroke, admitting additive into the pump cylinder to form the liquid and additive mixture, discharging the liquid and additive mixture from the pump cylinder while executing a discharge stroke.

The method is further characterized by discharging the liquid and additive mixture from the pump cylinder through an aerating means to add air to the liquid. The method is further characterized by admitting the additive into the liquid due to a pressure differential across an additive conduit containing the additive.

A detailed disclosure following, related to drawings, describes a preferred apparatus and method according to the invention, which are capable of expression in apparatus and method other than those particularly described and illustrated.

DETAILED DISCLOSURE

FIG. 1

Figure 1:
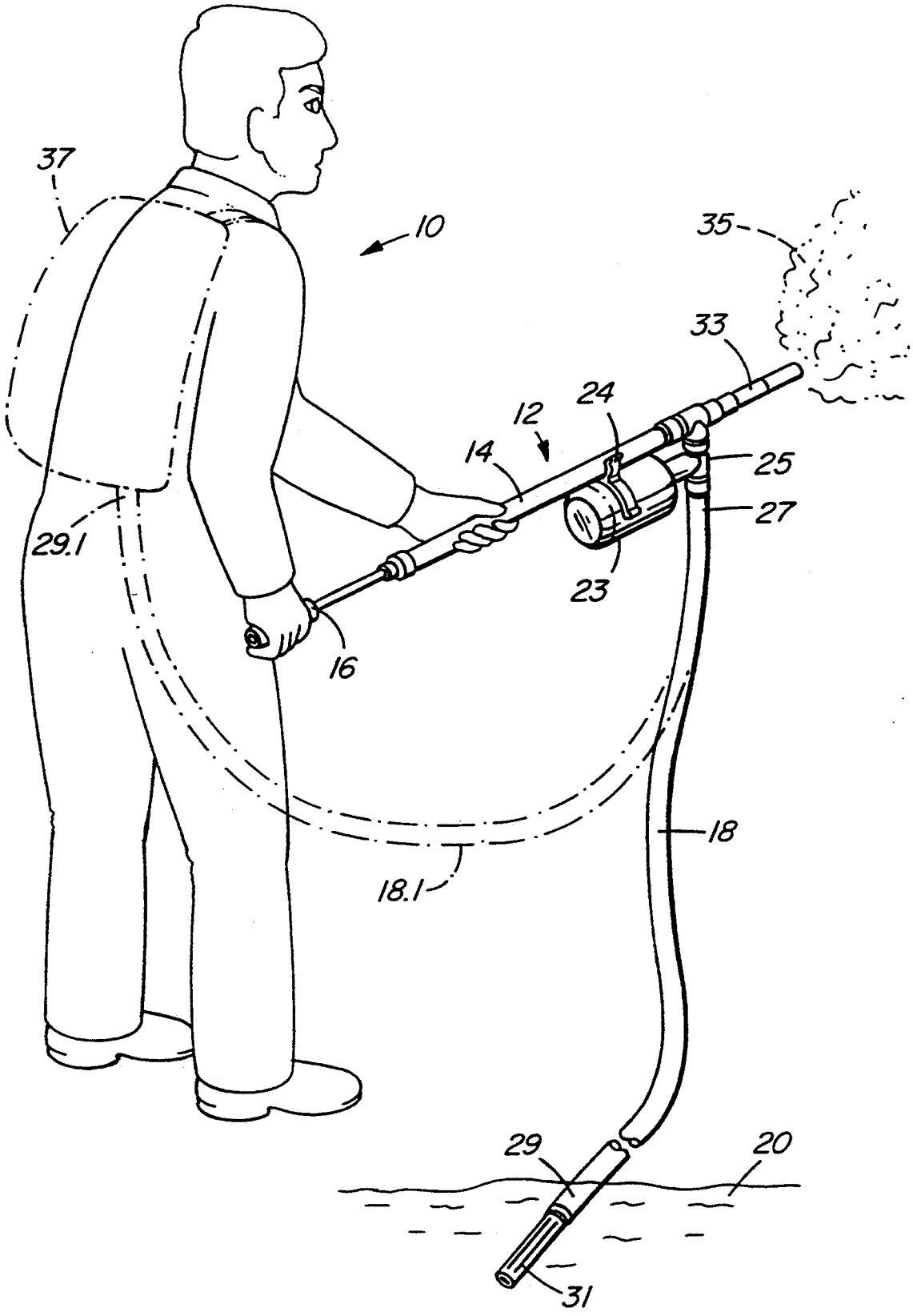
FIG. 1 shows an operator operating a pump apparatus according to the invention, the apparatus receiving liquid from a supply, or from an optional backpack carried by the operator.

An operator 10 is shown holding a pump apparatus 12 according to the invention, with one hand gripping a pump body 14, and the other hand gripping a pump handle 16. The apparatus 12 also includes a liquid intake hose extending from a liquid supply 20, typically a lake or the sea or other water supply. The apparatus 12 further includes an additive supply bottle 23 connected to the body 14 by a bottle holder 24 and communicating with a mixing means 25 which also communicates with the body and an inner end 27 of the hose 18. The hose 18 also has an outer end 29 cooperating with an intake filter 31 which filters large solids from the water supply 20, so as to reduce chances of blockage in the pump apparatus 12. The pump body 14 has a discharge nozzle 33 through which a spray 35 is discharged during a discharge stroke. For firefighting applications, the additive supply bottle 23 contains a firefighting foam concentrate liquid, and the discharge nozzle 33 is a foam generating nozzle as will be described.

The operator has an optional backpack 37, shown in broken outline, which can be used to provide an alternative liquid supply, in which case the filter 31 would be removed from the hose 18, which is shown in broken outline at an alternative position 18.1, in which an outer end 29.1 of the hose communicates with a lower portion of the backpack to receive the liquid therefrom. This has particular applications in fighting small brush fires where a natural adequate supply of water is not easily available. Thus, the backpack 37 provides a liquid reservoir to provide the liquid supply, with a flexible hose extending from the backpack to the mixing means 25. The backpack 37 would normally be made of a flexible, impermeable, chemical-resistance fabric to contain liquid, which can collapse as liquid is withdrawn therefrom, thus eliminating the need for a breather opening. Alternatively, a rigid container can be mounted on a backpack frame, not shown, with suitable breather openings as required.

Figures 2, 2B:
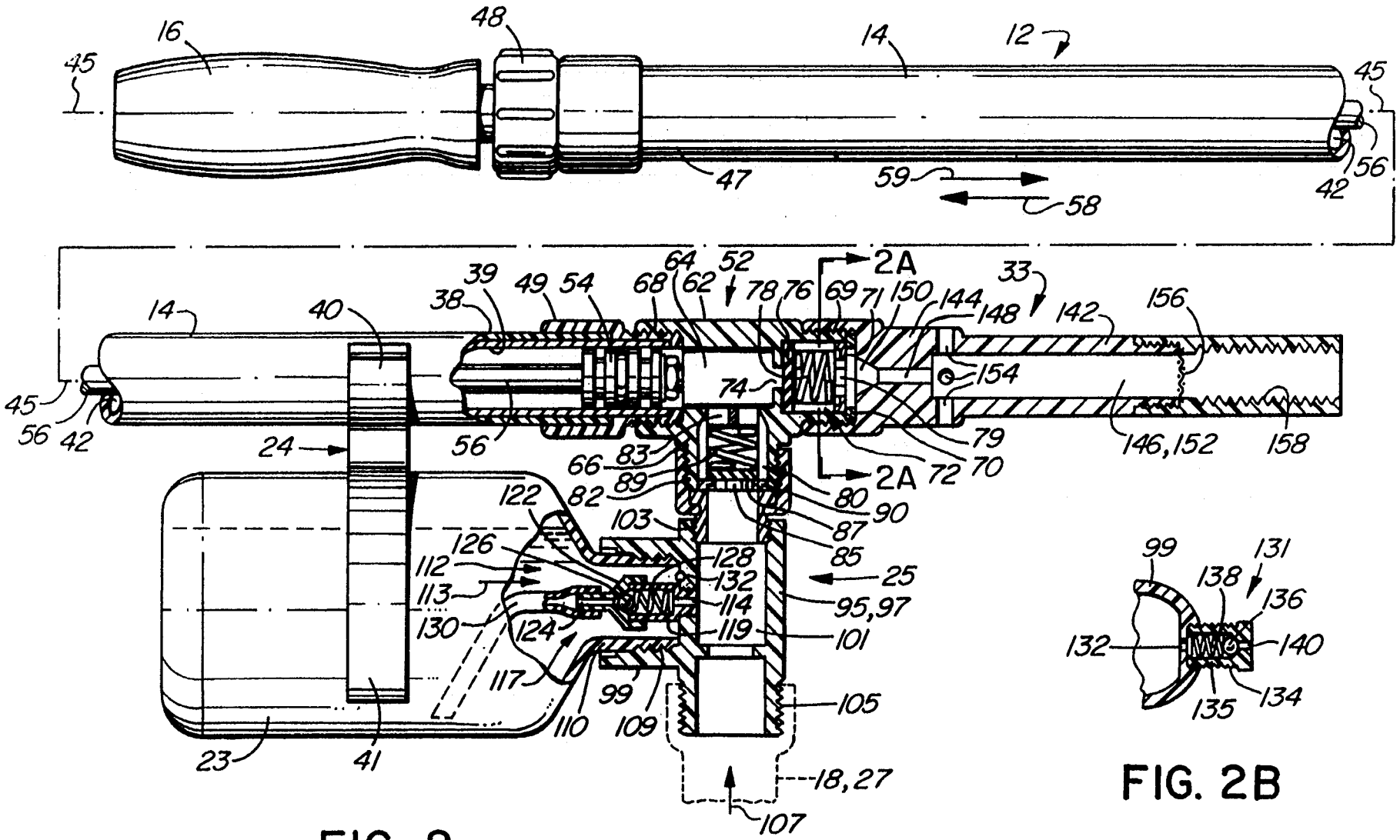
FIG. 2 is a fragmented, partially sectioned elevation of a pump apparatus according to the invention.
FIG. 2B is an enlarged fragmented section through a breather means associated with an additive supply.
Figure 2A:
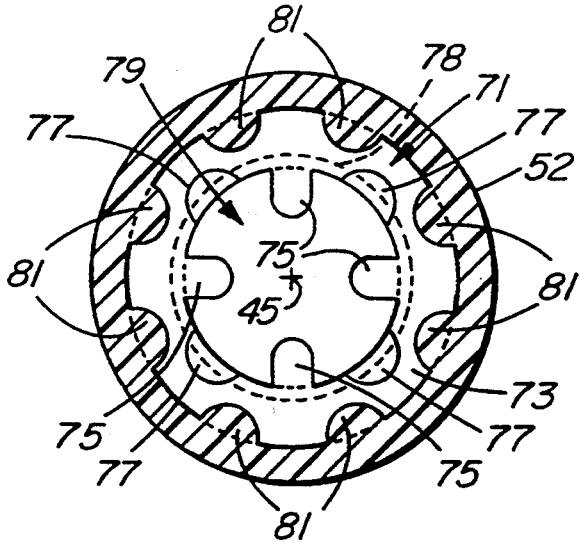
FIG. 2A is an elongated fragmented section of a portion of a discharge valve, as seen generally from Line 2A—2A of FIG. 2.

FIGS. 2, 2A and 2B

Referring mainly to FIG. 2, the pump body 14 comprises a combination of a tough plastic tube 38 enclosing a relatively thin brass liner 39, the combination providing a tough pump body which can withstand much of the physical abuse that can occur when fire-fighting, and yet will also provide efficient pumping for a long services life.

The bottle holder 24 has interconnected small and large U-shaped portions 40 and 41 with openings at opposite ends thereof, the smaller portion being complementary to the body 14, and the larger portion being generally complementary to body of the bottle 23. In this way, the bottle 23 is releasably attached to the body of the pump, and can be easily removed if it is not required, or to facilitate refilling of the bottle.

The pump body 14 is hollow and provides a pump cylinder 42 having a longitudinal pump axis 45, in FIG. 2 the pump body being shown broken for convenience. The pump body has an inner end portion 47 having a threaded end cap 48 to permit assembly and disassembly of the pump. The pump body has an outer end portion 49 cooperating with a valve body 52 which is interposed between the pump body 14 and the discharge nozzle 33. The pump apparatus also includes a piston 54 and an associated piston rod 56, the piston being adjacent the outer end portion 49 when the piston rod is retracted as shown. The piston 54 and the handle 16 are provided at opposite ends of the piston rod 56. The piston is reciprocable axially within the cylinder to execute intake and discharge strokes in directions of arrows 58 and 59 respectively.

The valve body 52 is generally T-shaped and has a main portion 62 with a main axial conduit 64 alignable with the pump axis, and a transverse portion 66 extending generally transversely from the main portion. The main portion has an inner end with a female screw thread 68 to engage a male screw thread adjacent the outer end portion 49 of the pump body, and an outer end with a male screw thread 69 to engage a female screw thread at an inner end of the discharge nozzle 33. Thus, it can be seen that the main portion 62 has releasable connecting means, namely the screw threads 68 and 69, at opposite inner and outer ends thereof.

The outer end of the valve body 52 also has a discharge valve 72 which has a discharge valve orifice 74 with an undesignated discharge valve seat extending peripherally around the discharge valve orifice. A movable flat, resilient disc-like discharge valve member 76 is located in an undesignated valve chamber and is resiliently urged by a valve spring 78 towards the discharge valve seat to close the discharge valve orifice. A spring stop 71 having a discharge valve port 79 therein locates an end of the spring 78 remote from the valve member 76 and thus effectively defines an outer end of the valve chamber. The spring stop is a disc with an upstream face facing into the valve, and a flat downstream face facing outwardly, and is retained in place by an interference fit with an undesignated rim adjacent an outer end of the body 52. A resilient sealing washer 70 seals a junction between the spring stop and the outer end of the body 52, and the discharge nozzle 33. FIG. 2A shows an upstream facing face 73 of the stop 71, and approximate location of end coils of the spring 78 on the face 73 (shown in broken outline) which extend closely around a periphery of a central opening in the stop which serves as the discharge port 79 of the discharge valve. Four equally spaced projections 75 extend radially inwardly into the port 79 and provide additional structure to locate the end of the spring on the spring stop, causing minimal obstruction to the orifice 79. Four equally spaced, semi-circular peripheral clearance recesses 77 are spaced symmetrically between the projections and provide clearance for liquid to flow past outside edges of coils of the spring when compressed, which coils would otherwise tend to block flow into the port 79. The valve chamber has a side wall provided with a plurality of axially extending ridges 81 against which the circular edge of the valve member 76 slides when moving between the closed and open positions thereof. The ridges 81 provide undesignated axial clearance grooves therebetween to transfer fluid past the edge of the valve member 76 when the valve is open. Thus, when the valve is open, the valve member 76 is displaced from its Valve seat and liquid from the valve orifice 74 passes the edge of the valve member, flows along the axial grooves and past the outside edges of the coils of the compressed spring 78, through the recesses 77 and then into the port 79 and out from the valve chamber. Thus, it can be seen that there is relatively convoluted route for liquid flowing through the discharge valve chamber which assists in agitating flow through the valve. For assembly purposes, it is important to note that the upstream face 73 of the spring stop 71 having the clearance recesses 77 faces into the valve body, and the essentially flat downstream face of the stop 71 faces outwardly from the valve body to be engaged by the resilient sealing washer 70.

The transverse portion 66 has an intake valve 80 and a male screw thread 82 serving as a releasable connecting means for cooperating with the mixing means 25 to receive liquid from the liquid supply as will be described. The intake valve 80 controls flow through an intake port 83 in the body 52 and is essentially structurally identical to the discharge valve 70, and has an intake valve orifice 85 with an undesignated intake valve seat extending peripherally around the intake valve orifice. A movable intake valve member 87 is resiliently urged by a valve spring 89 towards the valve seat to close the intake valve orifice. In contrast with the discharge valve, the intake valve has an undesignated spring stop formed by structure of the intake port 83. The intake valve orifice 85 is provided in a valve seat disc 90 which can be structurally identical to the valve stop 71 of the discharge valve, but is located in a reverse orientation when compared with the disc of the spring stop 71. In other words, a flat face of the disc 90, which is equivalent to the downstream facing flat face of the stop 71, faces inwardly or downstream into the intake valve to provide a flat valve seat for the member 87. Consequently, an upstream face of the disc 90, which is equivalent to the upstream face of the spring stop 71 with the recesses 77, faces outwardly of the valve body. This permits the same component to be used in two different locations of the valve body, but, when the assembled valve body 52 is viewed from the outside, the spring stop 71 and the valve seat disc 90 have opposite faces of the discs exposed. The stop 71 and disc 90 are both located by interference fits in the appropriate portion of the valve body, permitting easy removal of main portions of the discharge and intake valves, thus facilitating field servicing of the valves. When used with contaminated water or contaminated foam concentrate, the valves can become obstructed with foreign matter during use, and can be easily cleaned in the field by removing the stop 71 or seat disc 90 with a small knife or screw driver. Interchangeability of these components simplifies field servicing as well as reducing manufacturing and inventory cost. Thus, it can be seen that the intake valve and the discharge valve are normally closed valves with the respective valve member being resiliently urged towards a complementary respective valve seat thereof.

The mixing means 25 has a generally T-shaped mixing body 95 which comprises a main tube 97 and a shorter transverse tube 99. The main tube has an intake conduit 101 and an inner end portion provided with female screw threads 103 which releasably connect with complementary male screw threads extending from the transverse portion 66 of the valve body to serve as releasable connecting means. The intake conduit 101 conducts liquid from the liquid supply to the intake port 83 as will be described. The main tube 97 has an opposite outer end portion provided with male screw threads 105 which connect with a coupling at the inner end 27 of the hose 18, (broken outline) which supplies liquid in direction of an arrow 107 into the mixing body and thus serve as releasable connecting means. The transverse tube 99 extends from an intermediate portion between the screw threads 103 and 105, and itself has female screw threads 109 to serve as releasable connecting means which cooperate with complementary male threads on a neck 110 of the additive supply bottle 23. The transverse tube 99 also has an additive conduit 112 which communicates with the intake conduit 101 to supply a flow of the additive in direction of an arrow 113 to water flow in the conduit 101 to produce the mixture as will be described. Thus the neck of the bottle provides an opening with a releasable connecting means for releasably connecting the bottle to the connecting means of the additive conduit.

The mixing means 25 also includes a metering means which comprises a metering passage 114 which penetrates a sidewall of the conduit 101 to communicate with the additive conduit 112. The metering passage has a diameter which is between about 0.025 and 0.031 inches (0.635 and 0.787 mms) to provide a degree of restriction to flow from the additive bottle, and thus limits volume flow of additive into the intake conduit 101, and is a factor determining eventual concentration of additive in the mixture. Flow through the intake conduit 101 is at a velocity sufficient to draw additive through the metering passage 114, and thus, while the diameter of the metering is important many other variables also influence the eventual concentration of foam. For a particular proprietary fire-fighting foam concentrate, minimum foam concentrate concentration for adequate foam is about 1 per cent of concentrate to liquid. Clearly, other types of foam concentrate might require different concentrations which would result in a different diameter of the metering passage and simple experimentation with other factors to be discussed.

The metering means further comprises an additive control valve 117 which cooperates with the additive conduit 112 as a check valve to essentially prevent reverse flow of liquid in the conduit 112, i.e. it prevents liquid in the conduit 101 from passing outwardly through the metering passage 114 and conduit 112 and into the bottle 23 to dilute the concentrate. The control valve 117 comprises a valve body 119 which also provides the metering passage 114 at an inner end where it is secured in the transverse portion of the main tube 97. The valve body has a valve cap 122 at an outer end thereof, the valve cap being partially conical to provide a valve seat extending around a valve intake orifice 124. A valve ball 126 is urged against the valve seat by a valve spring 128 so as to close the intake orifice 124 against reverse flow into the bottle. The valve 117 provides some resistance to flow of the additive, which produces a metering effect on inwards flow, and while this is not the prime purpose of the valve, it can affect final concentration of foam in the liquid. Clearly, size and length of the orifice 124 and strength of the spring 128 will also effect resistance to flow and final concentration of foam. The additive conduit 112 further includes a supply tube 130 which extends from the valve cap 122 and is curved towards a lower portion of a side wall of the bottle 23 to facilitate drawing additive into the additive conduit when the bottle is disposed so that a longitudinal axis thereof is generally horizontal. As best seen in FIG. 1, the bottle 23 is normally located generally vertically below the pump body 14, and thus the tube 130 facilitates draining most of the additive from the bottle when the pump is held as shown in FIG. 1.

Referring to FIG. 2B, the transverse tube 99 has a breather means 131 comprising a breather passage 132 which communicates with a threaded breather sleeve 134, which sleeve has a breather conduit 135 carrying a valve ball 136 and resilient spring 138. Approximate location of the breather passage 132 is shown in FIG. 2. An outer end of the cap 134 has a valve seat surrounding a breather orifice 140 which communicates with atmosphere and is normally closed by the valve ball 136 held thereagainst by the spring 138. The breather means 131 thus communicates with the additive conduit 112 to admit air into the conduit during an induction stroke to facilitate supply of additive from the bottle 23. The breather means also has a check valve, i.e. the ball 136 and seat, to prevent leakage of additive through the breather opening which could otherwise occur if the bottle was positioned so that the breather opening was immersed in additive, when stored, or carried casually.

The discharge nozzle 33 is an aerating nozzle if the pump is to be used to generate firefighting foam or foam for other applications. The nozzle comprises a nozzle body 142 having an inner end portion 144 having releasable connecting means, e.g. female screw threads, which are complementary to the releasable connecting means at the outer end of the main portion having the discharge valve 72. Thus, it can be seen that the discharge nozzle 33 is an aerating means which communicates with the discharge port so as to receive a mixture of additive and liquid discharged through the port 79 in a discharge stroke. The nozzle body further comprises a nozzle passage 146 extending through the nozzle body, the passage having a restrictor orifice 148 of cylindrical cross-section and reduced diameter with respect to a converging inlet passage 150 on an upstream side of the restrictor orifice, and a generally parallel discharge passage 152 on a downstream side of the orifice and extending the remaining length of the nozzle body. The nozzle of the present invention has been tested using a delivery pressure of about 50 psi (345 Kpa) and has a nominal flow rating of approximately 3 U.S. gallons per minute (11.3 liters per minute). Assuming an induction stroke takes approximately as much time as a discharge stroke, for normal operation the pump would delivery approximately 1.5 U.S. gallons per minute (5.7 liters per minute). On this basis, the restrictor orifice 148 has a diameter of about 0.156 inches (3.96 mms) and the passage 152 has a diameter of 0.500 inches (12.7 mms). Thus, cross-sectional area of the orifice 148 is 0.019 sq. inches (12.26 sq. mms) and the discharge passage 152 has a cross-sectional area of 0.196 sq. inches (126.46 sq. mms). The nozzle body has a plurality of air entrainment openings 154 extending radially therethrough and spaced peripherally around the inner portion to communicate with the outlet passage downstream from the restrictor orifice 148. Following normal practice, the air entrainment openings 154 have a total cross-sectional area approximately equal to one-half of the cross-sectional area of the discharge passage 152 of the nozzle. Thus, based on the dimensions given above, the four air entrainment openings 154 of a nozzle would have a total cross-sectional area of 0.098 sq. inches (68.22 sq. mms). Thus, each air entrainment opening would have a diameter of 0.175 inches (4.45 rams).

A fine wire screen 156 can be fitted downstream from the air entrainment openings to provide a relatively large length of thin wire to augment generation of foam, while producing minimal restriction of flow of foam through the discharge passage 152. In addition, a plurality of spiral or annular grooves 158 are provided around an outer portion of the discharge passage 152 to provide additional surfaces and a long length of sharp edges to augment generation of foam prior to discharge through the outer end of the nozzle.

OPERATION

Referring to FIG. 1, it is assumed that the operator is adjacent the liquid supply 20, which can be a naturally occurring body of water or storage tank in which the intake filter 31 is immersed so as to supply liquid to the hose 18. Thus, surface of the water can be a maximum depth of about 10–15 feet (3 through 5 meters) below the pump, but clearly, the greater the depth of the surface below the pump, the more work required to draw water up the hose 18, which in general will slow rate of operation of the pump. The method of operating the pump is as follows, and is described with reference to FIGS. 9 and 2A. The operator holds the pump body 14 with one hand, and with the other hand draws the handle 16 outwardly in direction of the arrow 58. This creates low pressure in the cylinder 42 which opens the intake valve 80. The low pressure draws liquid up the hose 18, through the intake conduit 101 in the mixing means 25 and then through the intake valve orifice 85 and the intake port 83 to be received in the main axial conduit 64.

As the liquid flows through the intake conduit 101, suction is generated in the metering passage 114 and conduit 112 which lifts the valve ball 126 off its seat and draws additive from the bottle 24 through the tube 130. The additive is controlled by restriction through the metering passage 114, and a desired amount of about one percent passes into the stream of liquid passing through the intake conduit 101. The pump body gradually fills with the mixture of water and additive as the piston 54 travels towards the end cap 48. During this time, the low pressure generated in the main axial conduit 64 exerts a differential pressure across the discharge valve orifice 74, augmenting closure of the valve member 76 against the respective valve seat.

The piston 54 reaches the end of the cylinder thus terminating the induction stroke, and a mixture of liquid and additive essentially fills the cylinder and main axial conduit 64 as well as the intake conduit 101. Clearly, the metering means cooperates with the additive conduit 101 to control rate of additive flow therethrough, which is relatively independent of operating frequency of the pump for normal operation of the pump. Consequently, variations of concentration of the foam concentrate in the mixture due to variations in operating frequency of the pump are negligible for practical purposes. It can be seen that the mixing means 25 is for mixing the additive with the liquid prior to passing into the intake port of the pump. Also, the additive supply, namely the bottle communicates with the pump cylinder to supply additive during an intake stroke so the additive is admitted into the pump cylinder prior to a discharge stroke.

The piston stroke is reversed by the operator applying a force to the handle 16 in direction of the arrow 59, causing the piston 54 to increase pressure in the pump cylinder and conduit 64, which opens the discharge valve 72 by lifting the valve member 76 off its seat against the spring 78. Simultaneously, a pressure differential is applied across the intake valve member 87, which augments spring force acting on the valve member 87 against the respective valve seat, thus closing the intake valve orifice 85 and port 83. As the piston 54 executes the discharge stroke, the mixture is forced through the discharge valve 72, and into the converging passage 150 and restrictor 148. The mixture passes through the restrictor 148, and is subjected to turbulence as it leaves the restrictor and enters the discharge passage 152. The mixture is agitated and simultaneously exposed to air drawn through the air entrainment openings 154, thus creating foam. Production of foam is further augmented by passage of the foam through the screen 155 and past the grooves 158 in the bore.

Thus, in summary, it can be seen that the method of the invention comprises drawing liquid into the pump cylinder while executing an intake stroke, and admitting additive into the pump cylinder to form the liquid and additive mixture essentially simultaneously with drawing in the liquid. This is followed by discharging the liquid and additive mixture from the pump cylinder while executing a discharge stroke. For foam generation, the method further includes discharging the liquid and additive mixture from the pump cylinder through an aerating means to add air to the liquid, preferably after passing through a restrictor. Important aspects of the method relates to admitting the additive into the liquid due to a pressure differential across the additive conduit containing the additive, which pressure differential is attained by exposing one end of the additive conduit to a flow of liquid prior to entering the pump.

It can be seen that the mechanism of the pump apparatus is very simple, as both the intake valve and discharge valve are pressure responsive so that valve opening and closing is entirely dependent on pressure differential across the valve, with closure being initiated by the valve spring. Consequently, valve timing is simple and automatic, and is independent of completion of a particular stroke, i.e. stroke reversal can occur at any position in the stroke. In addition, there is essentially no chance of valve opening overlap occurring during normal operation because the intake valve opens during an intake spoke to admit liquid while the discharge valve is closed, and the discharge valve opens during the discharge stroke while the intake valve is closed.

Clearly, the communication between the metering passage 114 and the intake conduit 101 provides a metering means for metering a first volume of additive with a second volume of liquid to attain a desired concentration in the mixture, and the metering means is located between the additive supply and the mixing means. While primary mixing of the additive and water takes place in the intake conduit 101 which is an integral portion of the mixing means, additional mixing occurs as the mixture passes through the intake valve into the pump cylinder, and further mixing occurs as the mixture passes outwardly through the discharge valve and through the restrictor. As both intake and discharge valves are pressure responsive and are opened by establishing a pressure differential thereacross, this ensures generating turbulence in the mixture as it passes through the valve, which by itself augments mixing of the additive with the liquid.

ALTERNATIVES

The description above assumes that there is an adequate supply of liquid closely adjacent the operator to permit a hose 18 of reasonable length to be immersed in the body of liquid 20. As previously indicated, in some situations, for example in fighting widely scattered brush fires, the operator carries a separate supply of water or liquid in the backpack 37, and the hose assumes the alternative position 18.1 with an outer end of the hose communicating with the lower portion of the backpack to receive liquid therefrom. This increases versatility of the apparatus for many applications, even for dealing with small domestic fires, or marine fires where access to a normal supply of water is not easily available.

In addition, yet a third alternative is envisaged but not illustrated, in which the bottle 23 and holder 24 are removed from the mixing means 25 and pump body respectively, and the hose 18.1 extends from the backpack 37 into the transverse tube 99 after first removing the supply tube 130. The backpack 37 is filled with foam concentrate, and the hose 18 supplies essentially unlimited amounts of water from the body of water 20. While this arrangement is not considered to be a usual arrangement for most fires, it would provide an essentially unlimited supply of foam concentrate which would permit operation of the pump for many hours without refilling. Thus, in normal applications the additive supply is a bottle containing additive, with the bottle having an opening with releasable connecting means releasably connected to the connecting means associated with the outer end of the additive supply. However, in exceptional circumstances, the additive supply can be the backpack 37 with an additional and alternative hose 18.1 as described.

The nozzle passage 146 of FIG. 9 is shown to have the downstream converging inlet passage 150 which feeds mixture into the restrictor orifice 148 of reduced diameter, which then expands into the considerably larger discharge passage 152 closely adjacent the air entrainment openings. This is a relatively low cost approach to generating foam, and in some instances, foam quality can be improved by providing an alternative discharge nozzle described below.

Figure 3:
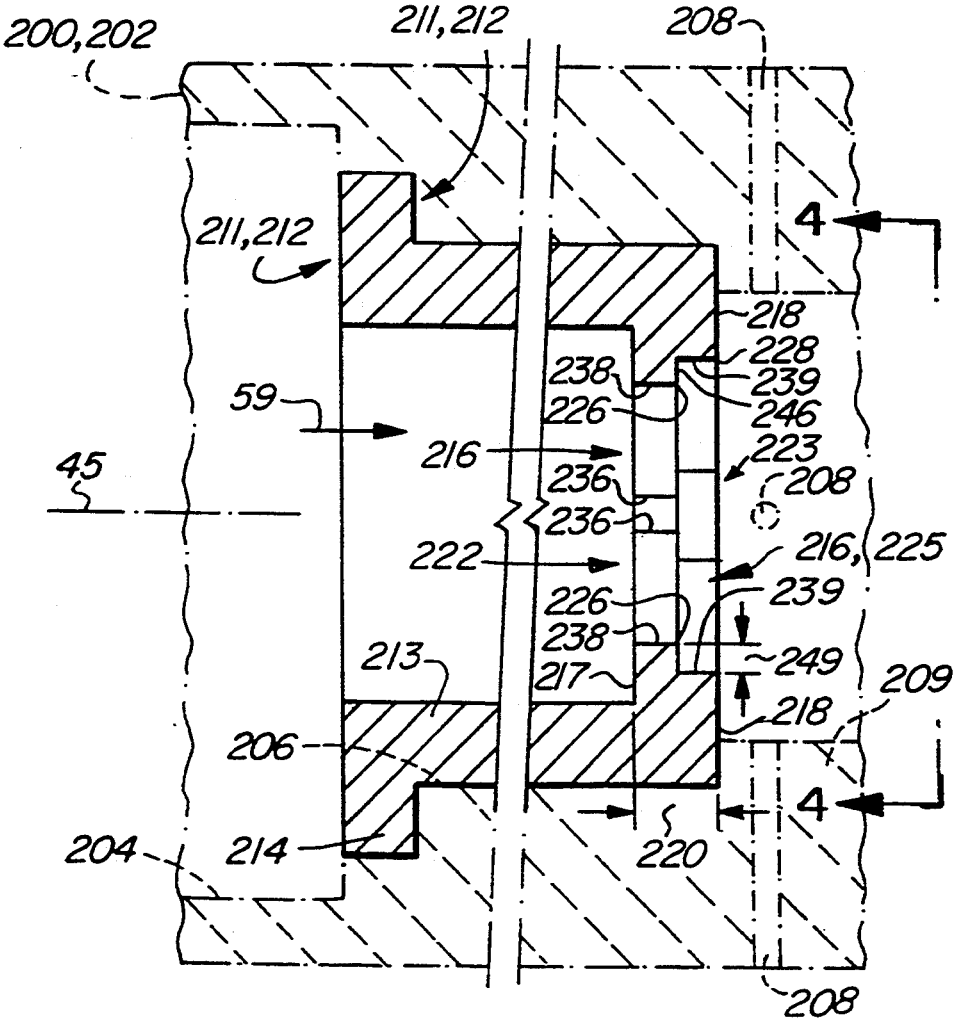
FIG. 3 is a simplified fragmented longitudinal section through a portion of an alternative discharge nozzle and foaming orifice, as will be seen generally on Line 3—3 of FIG. 4.
Figure 4:
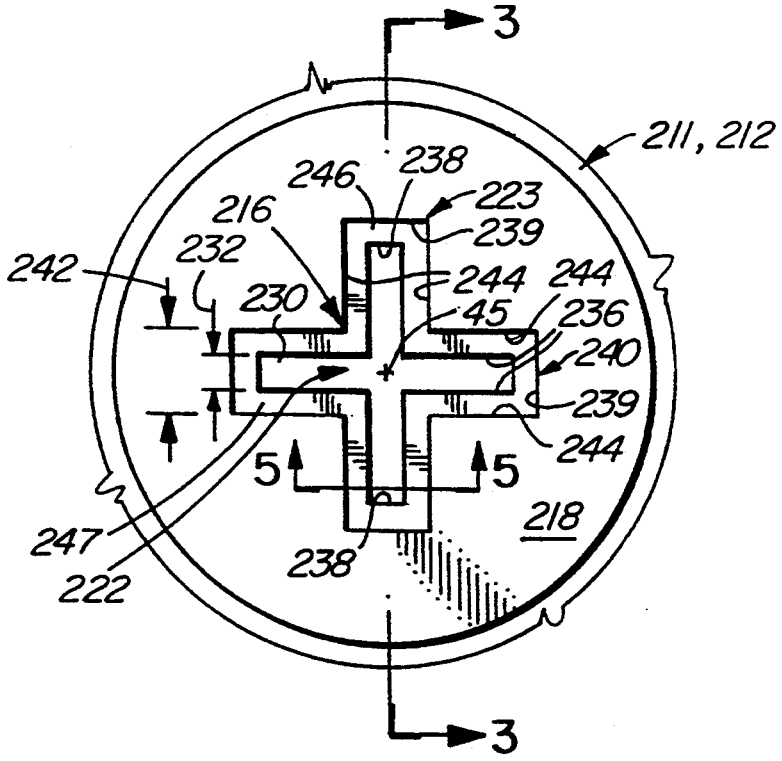
FIG. 4 is a simplified, fragmented rear elevation of a downstream side of the foaming orifice as seen generally on Line 4—4 of FIG. 3, showing portions of the alternative nozzle.
Figure 5:
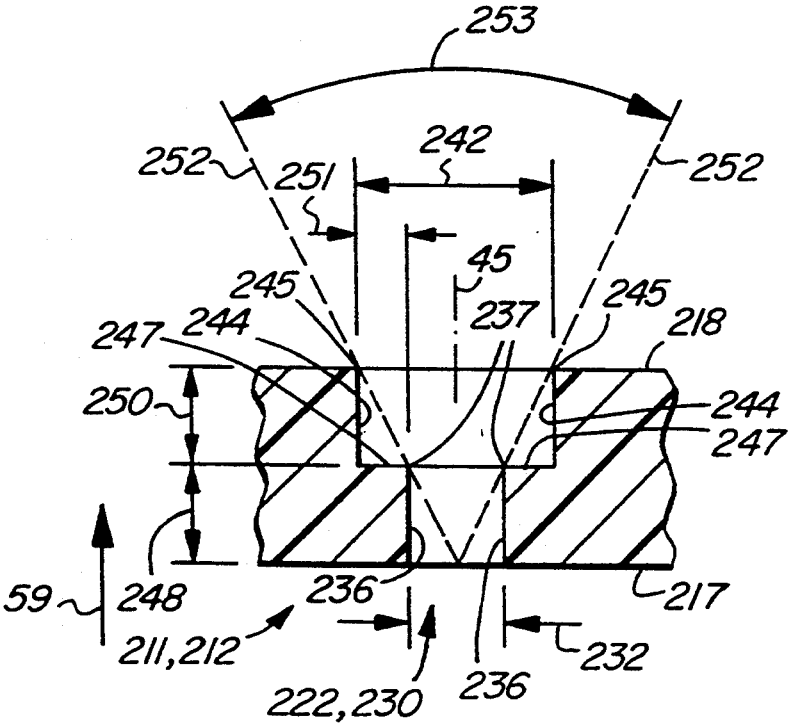
FIG. 5 is a simplified fragmented section on Line 5—5 of FIG. 4.

FIGS. 3, 4, and 5

Referring to FIG. 3, an alternative discharge nozzle 200 according to the invention has a nozzle body which is shown fragmented in broken outline. The nozzle body 202 has an alternative upstream or inner end portion 204 having a stepped recess 206 which receives the water/foam mixture from the discharge valve 72 (FIG. 2), and the restrictor orifice 148 of FIG. 2 is eliminated. The nozzle 200 has a downstream portion with a discharge passage 209 which is generally similar to the discharge passage 152 of the nozzle body 142 as shown in FIG. 2. The body 202 has a plurality of air entainment openings which pass radially into the discharge passage 209 downstream from the recess 206, and can be similar to the openings 154 of FIG. 2. The recess 206 receives an agitator means 211 which serves the same function as the restrictor orifice 148 of FIG. 2, but in some circumstances is considered to generate an improved foam, for example when the rate of discharge through the nozzle is relatively slow, possibly due the operator becoming tired.

The agitator means 211 has an agitator body 212 which resembles a top hat in longitudinal section and has a generally cylindrical thin walled sleeve portion 213, a sleeve rim 214 at an inner end thereof, and a main orifice portion 215 at an outer end. The sleeve rim 214 and sleeve portion 213 assist in locating the main portion 215 accurately with respect to the air entrainment openings 208. The main portion 215 has a front or upstream face 217, and a rear or downstream face 218, axial distance between the faces defining thickness 220 of the agitator means. As also seen in FIG. 4, the face 218 is circular so as to be complementary to the recess 206 and has an agitator orifice 216, located centrally therein and symmetrically of the pump axis 45 to serve the same purpose as the restrictor orifice 148 of FIG. 2.

In FIG. 3, the faces 217 and 218 have an inlet jet opening 222 and an outlet jet opening 223 respectively, which are disposed symmetrically about the longitudinal pump axis 45 passing through the center of the agitator jet orifice 216, the axis 45 also serving as a jet axis. The body 212 is integral, ie is in one piece for manufacturing convenience and maintaining registration, and the terms upstream, downstream, inlet, and outlet refer to general direction of flow through the agitator jet orifice 210 in direction of the arrow 59 corresponding to a discharge stroke. The outlet jet opening is larger than the inlet jet opening and communicates with the inlet jet opening to define a single downstream passage 225 of the orifice 211 having a pair of generally similar, oppositely facing, first steps 226 which are located on opposite sides of the orifice as best seen in FIG. 3. In addition, portions of the rear face 218 adjacent the outlet jet opening provide a pair of generally similar, oppositely facing, second steps 228 which are spaced further apart than the first steps 226, thus further defining portions of the diverging passage 225 through the orifice 210.

As best seen in FIG. 4, the inlet jet opening 222 has a plurality of generally similar, elongated inlet slits 230 extending radially outwardly from the jet or nozzle axis 45 and disposed to define a symmetrical four-pointed star-shaped pattern. The inlet slits each have a width 232 defined by space between oppositely facing inlet slit side walls 236, two only being designated in FIG. 4 and shown in FIG. 5. Preferably, the inlet slit side walls 236 are parallel to each other and disposed symmetrically on opposite sides of a radius, not shown, extending from the axis 45, and have outer ends interconnected by a straight slit end wall 238. Also, the outlet jet opening 223 has a plurality of generally similar elongated outlet slits 240 extending radially outwardly from the jet or nozzle axis 45, the outlet slits having a width 242 defined by space between oppositely facing outlet slit sidewalls 244, two only being designated in FIG. 4 and shown in FIG. 5. The sidewalls 244 of each slit are interconnected at outer ends by an outlet slit end wall 239. Both the inlet slit end walls 238 and 238 are straight but this is immaterial as they could be curved. One of the prime purposes of the jet orifice 216 is to provide a relatively long length of sharp step edges for a given overall cross-sectional area of the orifice 216. As can be seen in FIG. 4, the length of step edges provided by the sets of slit end walls of the orifice 216 is considerably less than the length of steps provided by the slit sidewalls, but all step edges contribute to the overall purpose of agitating the mixture as it passes through the jet orifice.

Referring to FIG. 3, the slit endwalls 238 and 239 are generally parallel to the axis 45 and a transverse portion 246 extends between the inlet slit end wall 238 and the outlet slit end wall 239 so as to provide a "tread" portion of the first step 226, the tread portion being disposed normally to the axis 45. As best seen in FIG. 5, the inlet slit sidewalls 236 and the outlet slit sidewalls 244 are generally parallel to each other and parallel to the axis 45. Also a transverse portion 247 extends between adjacent inlet slit sidewalls 236 and outlet slit sidewalls 244 to define the first step 237 and is also a "tread" position disposed normally to the axis 45. The outlet slit sidewalls 244 intersect the downstream face 218 to define relatively sharp edges of second steps 245. The transverse portions 246 and 247 are generally coplanar and extend around the periphery of the orifice, and are also in a plane parallel to the upstream and downstream faces 217 and 218, and disposed at a midpoint between the plane. Consequently, the inlet slit sidewalls 236 and the outlet slit sidewalls 244 have respective axial depths 248 and 250 which are equal to each other and equal to one-half of the thickness 220, and equal to undesignated axial depths of the slit end walls. The transverse portion has a width 251 which is of a similar order of magnitude as the axial depths 248 and 250 although this is not critical. Referring to FIG. 3, the transverse portion 246 adjacent the end walls of the slits has a similar width 249 but this is generally unimportant.

Referring to FIG. 5, the width 242 of the outlet slit is preferably about twice the width 232 of the inlet slit, which provides a theoretical angle of divergence of flow through the orifice 211 as follows. A pair of inclined broken lines 252 interconnect edges of the first and second steps 237 and 245 on opposite sides of a pair of slits, and an angle 253 is subtended by the lines 252 as shown. The angle 253 is dependent on relative sizes of the dimensions 248, 250 and 251 and can vary between about 45 and 90 degrees. Selection of angle is also dependent to some extent on the size of the discharge nozzle passage 209. Lines interconnecting edges of steps 226 and 228 at the end walls of the slits subtend similar angles, as sown in FIG. 3. Thus, the single diverging stepped passage 225 through the agitator jet orifice 216 is in fact a plurality of interconnected diverging elongated passages arranged as a four-pointed star, each passage extending downstream and outwardly from the orifice into the nozzle body as will be described.

The axial and transverse portions of all the steps intersect at a right angle of 90 degrees to define an edge of the respective step. Clearly, all the slit sidewalls and slit end walls are generally parallel to the jet axis, whereas the transverse portions, both on the sidewalls and end walls, are generally normal to the jet axis. The edges of the steps should be relatively sharp, although the actual angle between adjacent sidewalls and transverse portions is less critical, but should be within a range of between about 70 degrees and 90 degrees.

Certain aspects of the agitator jet orifice 216 have critical dimensions, and the dimensions are dependent upon operating parameters of water flowing through the nozzle, e.g. primarily minimum volume flow, which can be a nominal 3 U.S. gallons (11.3 liters) per minute for normal continuous manual operation, i.e. without a return stroke.

The agitator jet orifice 216 has a net cross-sectional area to match the nozzle flow rate above, and is generally equal to the orifice 148 of FIG. 2. The area of the orifice 216 is based on size of the inlet jet opening 222 which has a total cross-sectional area of 0.0175 sq. inches (11.29 sq. mms.), which is the sum of four (4) radial inlet slits. Each diametrical pair of inlet slits has an overall diametrical length measured between the end walls of about 0.200 inches (5.08 mms) and an inlet slit width 232 of about 0.050 inches (1.27 mms). The outlet jet opening 223 has a total area of 0.050 sq. inches (32.26 sq. mms) and each diametrical pair of outlet slits has an overall diametrical length measured between the end walls of about 0.300 inches (7.62 rams) and an outlet slit width 242 of about 0.100 inches (2.54 mms). The transverse portions 246 and 247 of the first steps 237 and 226 of the sidewalls and endwalls have respective widths 249 and 247 of 0.100 inches (2.54 rams). The axial depths 248 and 250 of the sidewalls, and similar depths of the end walls are 0.100 inches (2.54 rams).

The discharge passage 209 of the alternate discharge nozzle 200 has an internal diameter of 0.500 inches (12.7 and an axial length of about 6 inches (152.4 mms). Following conventional practice, the total area of air entrainment openings 208 equals approximately one-half of the cross-sectional area of the discharge passage 209. Thus, for a discharge passage 209 having a cross-sectional area of 0.196 sq. in. (126.46 sq. rams), the total area of the four air entrainment openings equals 0.098 sq. in. (126.46 sq. mms). Thus, for four openings as shown, each opening has a diameter of 0.175 inches (14.45 rams).

The operation of the pump using the alternative discharge nozzle 200 does not differ from that as before. However, the alternative nozzle orifice is considered to facilitate foam generation when compared with the simple cylindrical bore orifice of the nozzle of FIG. 2, and this permits operation of a given pump at a lower frequency while generating a similar volume of foam. However, when operating at a lower frequency, as discharge velocity will be lower, "throw" of foam from the pump will also be shorter. Consequently, in order to maintain a similar throw of foam from the pump, or operating range, both pumps should be operated at the same frequency, and this will in general, permit generation of better quality foam in the second embodiment.

The improved effectiveness of the alternative foaming nozzle of the present invention is attributed to the severe turbulence being generated in the water/foam mixture as it passes through the agitator means, in particular, as it passes over the edges of the first steps 226 and 237 provided between the inlet and outlet jet openings 222 and 223, and then the second steps 228 and 245 against the downstream face 218. It is assumed that a phenomenon associated with fluid dynamics, termed the "Coanda effect" augments agitation as the column of the water/foam concentrate mixture commences to "expand" upon entering the diverging passage 225 and passing through the inlet slit opening where it is drawn first around the first steps 226 and 237, and then into the outlet slit where the mixture passes around the second steps 228 and immediately prior to being exposed to air passing through the air entrainment openings It can be seen from FIG. 4 that the four radially aligned pairs of inlet and outlet slits provide a considerable length of sharp edges for a relatively small cross-sectional area of orifice. Thus, it is anticipated that a large portion of the relatively small cross-sectional area of mixture passing through the agitator means is subjected to passing sequentially over the two sharp edges of steps, which thoroughly agitate the mixture in a very short length. Immediately after the agitation, large volumes of air are supplied to assist in generating foam, which can then expand into the relatively large nozzle discharge passage 209. The highly agitated foam is discharged from the nozzle outlet portion over "throw" distances of approximately 15 feet (4.57 meters) for a normal manual operation of approximately 1.5 U.S. gallons per minute (5.7 liters per minute).

Thus, in summary, it can be seen that the alternate foam generation method of the invention is characterized by admitting foam concentrate into a flow of water to form a foam/water mixture and passing the mixture through a relatively small jet opening and across at least one first step edge into a relatively large jet opening to agitate the mixture, followed by entraining air into the agitated mixture to generate the fire fighting foam. Preferably, the mixture is passed across a plurality of step edges between the inlet and outlet jet openings to provide a long length of edges around a relatively small opening. Also after passing the mixture over the first step edges, the mixture is preferably passed over second step edges prior to entraining air therein. Also, preferably the foam concentrate is admitted into the mixture by enclosing a moving column of water with a thin film of foam concentrate to form the mixture.

Thus, it can be seen that the agitator means comprises an inlet jet opening and an outlet jet opening, the outlet jet opening being larger than the inlet jet opening and communicating with the inlet jet opening to provide at least one pair of openings in communication with each other to define a diverging passage. The step means is located between the inlet and outlet jet openings, and flow through the agitator jet opening passes across the step means to agitate the flow to enhance foaming.

We claim:

1. A reciprocating pump apparatus for dispensing a liquid and additive mixture, the apparatus comprising:

(a) a hollow pump body providing a pump cylinder having a longitudinal pump axis, the pump cylinder communicating with an intake port having an intake valve, and a discharge port having a discharge valve;

(b) a piston and associated piston rod reciprocable axially within the cylinder to execute intake and discharge strokes, the intake valve opening during an intake stroke to admit liquid while the discharge valve is closed, and the discharge valve opening during a discharge stroke while the intake valve is closed, the stroke of the piston being at least several times greater than diameter of the pump cylinder to provide a relatively long stroke pump;

(c) an additive supply communicating with the pump cylinder to supply additive during an intake stroke so that the additive is admitted into the pump cylinder prior to a discharge stroke, (d) a mixing means for mixing the additive with liquid from a liquid supply prior to passing into the intake port, the mixing means being located between the additive supply and the intake valve and comprising a mixing body having an intake conduit to conduct the liquid from the liquid supply to the intake port, and an additive conduit communicating the additive supply with the intake conduit, a portion of the intake conduit adjacent the additive conduit being of fixed cross-section to provide an essentially constant restriction to liquid flow therethrough; and (e) a metering means for metering a first volume of additive in proportion to a second volume of liquid to attain a desired concentration in the mixture, the metering means cooperating with the additive conduit to control rate of additive flow therethrough in proportion to liquid volume flow rate in the intake conduit occurring during an induction stroke, so as to mix the additive with the liquid in an essentially constant concentration irrespective of velocity of liquid flow therethrough.

2. An apparatus as claimed in claim 1 in which:

(a) the mixing body is generally T-shaped and comprises a main tube and a transverse tube, the main tube having the intake conduit and opposite end portions provided with releasable connecting means and an intermediate portion disposed between the opposite end portions, the transverse tube extending from the intermediate portion and having a releasable connecting means to communicate with the additive supply; the transverse tube communicating with the additive conduit; and (b) the metering means further comprising a metering passage communicating with the additive conduit, the metering passage have a diameter which is dependent on diameter of the intake conduit to attain a desired concentrate ratio of concentrate to liquid.

3. An apparatus as claimed in claim 2 further comprising:

(a) an additive control valve co-operating with the additive conduit to control flow of additive into the metering conduit.

4. An apparatus as claimed in claim 2 in which:

(a) the additive supply is a bottle .containing additive liquid, the bottle having an opening with a releasable connecting means releasably connected to the connecting means of the additive conduit, and (b) the mixing body further includes a breather means to admit air as required into the transverse tube to facilitate supply of additive from the bottle.

5. An apparatus as claimed in claim 4 in which:

(a) the breather means is a breather opening with a check valve to prevent leakage of additive from the bottle.

6. An apparatus as claimed in claim 1 in which:

(a) the mixing means has an intake conduit to conduct liquid from the liquid supply to the intake port, and an additive conduit to receive the additive from the additive supply, the conduits communicating within the mixing means to mix additive with the liquid, the additive conduit having a releasable connecting means associated with an outer end thereof;

(b) the additive supply is a bottle containing additive; the bottle having an opening with , releasable connecting means releasably connected to the connecting means associated with the outer end of the additive conduit;

(c) a holder extends from the pump body to releasably hold the bottle; and (d) an aerating means communicates with the discharge port.

7. An apparatus as claimed in claim 6 in which:

(a) the additive conduit has a supply tube extending away from the pump body and towards a side wall of the bottle to facilitate drawing additive into the additive conduit.

8. An apparatus as claimed in claim 6 further comprising:

(a) a breather means communicating with the additive conduit to admit air into the conduit to facilitate supply of additive from the bottle.

9. An apparatus as claimed in claim 8 in which:

(a) the breather means is a breather opening with a check valve to prevent leakage of additive through the breather means.

10. An apparatus as claimed in claim 6 further comprising:

(a) a backpack for wearing on a person's back, the backpack supporting a liquid reservoir to provide the liquid supply;

(b) a flexible hose extending from the backpack to the intake conduit of the mixing means.

11. An apparatus as claimed in claim 6 further comprising:

(a) a generally T-shaped valve body having a main portion with a main axial bore alignable with the pump axis, and a transverse portion extending generally transversely from the main portion, an outer end of the main portion having the valve, and an inner end of the main portion having releasable connecting means for securing to an outer end of the pump body, the transverse portion having the intake valve and releasable connecting means thereon for cooperating with the liquid supply;

(b) the intake valve having an intake valve orifice with an intake valve seat extending peripherally around the intake valve orifice, and a movable intake valve member resiliently urged towards the valve seat to close the intake valve orifice) and (c) the discharge valve having a discharge valve orifice with a discharge valve seat extending peripherally around the discharge valve orifice, and a movable discharge valve member resiliently urged towards the discharge valve seat to close the discharge valve orifice.

12. An apparatus as claimed in claim 11 further comprising:

(a) an aerating means having releasable connecting means which are complementary to releasable connecting means at the outer end of the main portion having the discharge valve so as to receive a mixture of additive and liquid discharged therethrough.

13. An apparatus as claimed in claim 12 in which the aerating means is an aerating nozzle comprising:

(a) a nozzle body having an inner end portion having the releasable connecting means, and a nozzle bore extending through the nozzle body, the bore having a restrictor orifice of reduced diameter with respect to an inlet passage on an upstream side of the restrictor orifice, and a discharge passage on a downstream side of the orifice; and b) the nozzle body having a plurality of air entrainment openings extending therethrough to communicate with the nozzle bore downstream from the restrictor orifice.

14. An apparatus as claimed in claim 13, in which:

(a) the restrictor orifice is a portion of an agitator means and comprises an agitator jet orifice having an inlet jet opening and an outlet jet opening disposed in series, the outlet jet opening being larger than the inlet jet opening and communicating with the inlet jet opening to define a diverging passage extending through the agitator means, (b) a first step means being located between the inlet and outlet jet openings, flow through the agitator jet openings passing across the first step means to agitate the flow to enhance foaming.

15. An apparatus as claimed in claim 14 in which the agitator means comprises:

(a) an agitator body having the inlet and outlet jet openings, the jet openings being aligned about a jet axis passing therethrough;

(b) the inlet jet opening having a plurality of elongated inlet slits extending outwardly from the jet axis, the inlet slits having a width defined by space between oppositely facing inlet slit side walls;

(c) the outlet jet opening having a plurality of elongated outlet slits extending outwardly from the jet axis, the outlet slits having a width defined by space between outlet slit side walls, the width of the outlet slits being greater than the width of the inlet slits; and (d) each pair of inlet and outlet openings has at least one step located between an inlet slit sidewall and an outlet slit sidewall adjacent one side of the slit.

16. An apparatus as claimed in claim 14 in which:

(a) the step has an axial portion and a transverse portion meeting at an angle to define an edge, (b) the axial portion is generally parallel to the jet axis;

(c) the transverse portion is generally normal to the jet axis; and (d) the edge is defined by a perpendicular intersection between adjacent axial and transverse portions.

17. An apparatus as claimed in claim 15 in which:

(a) the inlet slit side walls are generally parallel to the jet axis;

(b) the outlet slit side walls are generally parallel to the jet axis;

(c) a first transverse portion extends between the inlet jet side walls and the outlet jet side walls, the transverse portion being generally normal to the jet axis and intersecting the inlet side walls at an angle to define an edge, the angle being generally about 90 degrees; and (d) a second transverse portion extends outwardly from the outlet slit side wall, the second transverse portion being generally normal to the jet axis and intersecting the outlet slit side wall at an angle to define a second step edge, the angle being generally about 90 degrees.

18. An apparatus as claimed in claim 1 in which:

(a) the liquid is water;

(b) the additive is a fire fighting foam liquid concentrate.

19. A reciprocating pump apparatus for dispensing a liquid and additive mixture, the apparatus comprising:

(a) a hollow pump body providing a pump cylinder having a longitudinal pump axis, the pump cylinder communicating with an intake port having an intake valve, and a discharge port having a discharge valve, the intake port being communicable with a liquid supply;

(b) a piston and associated piston rod reciprocable axially within the cylinder to execute intake and discharge strokes, the intake valve opening during an intake stroke to admit liquid while the discharge valve is closed, and the discharge valve opening during a discharge stroke while the intake valve is closed;

(c) an additive supply communicating with the pump cylinder to supply additive during an intake stroke so that the additive is admitted into the pump cylinder prior to a discharge stroke, the additive supply being a bottle containing additive and having an opening with releasable connecting means;

(d) a mixing means for mixing the additive with the liquid, the mixing means admitting the additive into the liquid prior to passing into the intake port, the mixing means having an intake conduit to conduct liquid from the liquid supply to the intake port, and an additive conduit to receive the additive from the additive supply, the conduits communicating within the mixing means to mix additive with the liquid, the additive conduit having a releasable connecting means associated with an outer end thereof, the releasable connecting means being releasably connected to the connecting means associated with the opening of the bottle;

(e) a holder extends from the pump body to releasably hold the bottle; and (f) an aerating means communicates with the discharge port.

20. An apparatus as claimed in claim 19 in which:

(a) the additive conduit has a supply tube extending away from the pump body and towards a side wall of the bottle to facilitate drawing additive into the additive conduit.

21. An apparatus as claimed in claim 19 further comprising:

(a) a breather means communicating with the additive conduit to admit air into the conduit to facilitate supply of additive from the bottle.

22. An apparatus as claimed in claim 21 in which:

(a) the breather means is a breather opening with a check valve to prevent leakage of additive through the breather means.

23. An apparatus as claimed in claim 19 further comprising:

(a) a backpack for wearing on a person's back, the backpack supporting a liquid reservoir to provide the liquid supply; and (b) a flexible hose extending from the backpack to the intake conduit of the mixing means.

24. An apparatus as claimed in claim 19 further comprising:

(a) a generally T-shaped valve body having a main portion with a main axial bore alignable with the pump axis, and a transverse portion extending generally transversely from the main portion, an outer end of the main portion having the discharge valve, and an inner end of the main portion having releasable connecting means for securing to an outer end of the pump body, the transverse portion having the intake valve and releasable connecting means thereon for cooperating with the liquid supply;

(b) the intake valve having an intake valve orifice with an intake valve seat extending peripherally around the intake valve orifice, and a movable intake valve member resiliently urged towards the valve seat to close the intake valve orifice; and (c) the discharge valve having a discharge valve orifice with a discharge valve seat extending peripherally around the discharge valve orifice, and a movable discharge valve member resiliently urged towards the discharge valve seat to close the discharge valve orifice.

* * * * *